US007434443B2

(12) United States Patent
Tokuda

(10) Patent No.: US 7,434,443 B2
(45) Date of Patent: Oct. 14, 2008

(54) COMPOUND PRESS-FORMING APPARATUS AND COMPOUND PRESS-FORMING METHOD

(75) Inventor: Hiroshi Tokuda, Hiroshima (JP)

(73) Assignee: Hirotec Corporation, Hiroshima (JP)

( * ) Notice: Subject to any disclaimer, the term of this patent is extended or adjusted under 35 U.S.C. 154(b) by 770 days.

(21) Appl. No.: 10/630,188

(22) Filed: Jul. 30, 2003

(65) Prior Publication Data

US 2004/0020261 A1 Feb. 5, 2004

Related U.S. Application Data

(60) Provisional application No. 60/421,260, filed on Oct. 24, 2002.

(30) Foreign Application Priority Data

Jul. 31, 2002 (JP) ..... 2002-222809
Apr. 11, 2003 (JP) ..... 2003-108058

(51) Int. Cl.
*B21J 13/08* (2006.01)
*B21D 28/00* (2006.01)
*B21D 53/88* (2006.01)

(52) U.S. Cl. ..... 72/452.9; 72/334; 29/897.2

(58) Field of Classification Search ..... 72/334, 72/353.2, 356, 403, 452.9, 313, 387, 315, 72/445, 306, 312, 322, 323, 353.4, 381, 386; 100/266; 29/897.2

See application file for complete search history.

(56) References Cited

U.S. PATENT DOCUMENTS 4,981,031 A * 1/1991 Schneider et al. ..... 72/405.05
5,440,912 A * 8/1995 Copeman ..... 72/334
6,196,040 B1 * 3/2001 Matsuoka ..... 72/315
6,530,255 B1 * 3/2003 Usui et al. ..... 72/334

OTHER PUBLICATIONS

Merriam-Webster's Collegiate Dictionary, Tenth edition, 1999, p. 1018.*

* cited by examiner

*Primary Examiner*—Derris H. Banks
*Assistant Examiner*—Teresa Bonk
(74) *Attorney, Agent, or Firm*—Fildes & Outland, P.C.

(57) ABSTRACT

An upper die 7 that is fixed to a ram 4*d* of a press machine 1 includes a forming punch 9 for conducting drawing, forming and listing, upper die-side cutting edges 13*a* for conducting trimming, and flat-face piercing punches 11 for conducting flat-face piercing, to respectively a work W in cooperation with a lower die 8. The lower die 8 is provided with a forming die 12 corresponding to the upper die 7, and a large piercing die 14, lower die-side cutting edges 8*e* and a flat-face piercing die 8*a* which are disposed at the forming die 12. A side-face working apparatus 17, including a rotating base 18 and a reciprocating base 19, is disposed at the side of the lower die 8 to conduct side-face press working to a side-face portion 3*g* of the work W jointly with the lower die 8.

14 Claims, 8 Drawing Sheets

COMPOUND PRESS-FORMING APPARATUS AND COMPOUND PRESS-FORMING METHOD

CROSS REFERENCE TO RELATED APPLICATION

This Application claims the benefit of U.S. Provisional Application No. 60/421,260 filed Oct. 24, 2002, Japanese Patent Application 2002-222809 filed Jul. 31, 2002, and Japanese Patent Application 2003-108058 filed Apr. 11, 2003.

BACKGROUND OF THE INVENTION

The present invention relates to a compound press-forming apparatus and a compound press-forming method, and particularly to the compound press-forming apparatus and the compound press-forming method, in which press working can be further conducted to a side-face portion of a work, to which press working by an upper die and a lower die has been conducted.

A certain press machine, in which a plurality of steps of press working are conducted by one set of dies constituted of an upper die and a lower die, is shown in Japanese Patent Laid-Open Publication 2000-233239. A compound press die shown in this publication is capable of conducting piercing of an inclined part and shearing/bending of an outer peripheral edge of a flange portion in one stroke.

Herein, a work is set in such manner that its bottom is positioned at the upper side and its flange part is positioned at the lower side. The compound press die includes a lower die that supports the inside face of the work, an upper die that is disposed facing the lower die and moves so as to be accessible to and away from the lower die, a pad that is disposed at the upper die and cooperates with the lower die to hold the outside face of the work when accessing the lower die, a pad ring that is disposed at the outer side of the pad and includes a cutter, a punch that is disposed against the inclined part of the work and supported so as to move in the substantially perpendicular direction to the surface of the inclined part of the work, and punch driving means that moves the punch.

Between the upper die and the lower die, the above-described pad, pad ring, punch, punch driving means, and a die supporting the inside face of the work, a cam operating the punch and a die cushion are provided. The punch driving means is placed inside the dies such that the punch can be moved in the perpendicular direction to the face to be worked (inclined part) to punch at the inclined part of the work, which is different from the movement direction of the upper die going up and down. In the event that a portion for piercing is different from the movement direction of the die and so the movement direction of the punch is different from that of the die, the movement direction is changed by placing the punch driving means constituted of a cam mechanism or a fluid-pressure mechanism inside the die. The punch by the punch driving means is placed at the pad that is disposed at the upper die and the pad is disposed to cover the upper face and the side face of the lower die. The pad is attached to the upper die by a pin interconnecting with a slit formed at the outer face thereof.

Further, in general, press-forming step of, for example, a door panel for vehicles, in which a panel is used as a work, is constituted of a drawing step of drawing the panel as the work into a shape with its desired depth and corners, and an excising step of excising unnecessary parts as scraps from the work that has formed by the drawing step. In the case of forming products with a relatively great depth by drawing, such as a door inner panel for vehicles, such drawing step comprises generally the first drawing step (may also be called just a drawing step) in which the work is formed roughly into a shape with a certain depth, the second drawing step (may also be called a forming step) in which the work is formed into a shape with the desired depth by applying further drawing, and a drawing finishing step (may also be called a listing step) in which the worker is formed into a final shape with its corners of the desired radius-magnitudes and the like. Also, the above-described excising step is a step of excising unnecessary parts of the work for the final product, and comprises generally a peripheral-edge cutting step (may also be called a trimming step) of cutting away a peripheral edge part of the work and a step of partially making holes or cutting (may also be called a piercing step or a notching step).

Herein, in the conventional compound press die shown in the above-described publication, the pad is disposed so as to cover the upper face and the side face of the lower die, and the pin and the slit are provided at the upper side and the outer face of the pad, and the pad ring including the cutter is disposed at the outer side of the pad. Accordingly, for some reasons of an interference or the like, just either work's upper face or inclined face which extends continuously from the upper face could be worked by punching of one press machine, and thus there was a problem that the press machine could not conduct press working to the side face of the work.

Accordingly, in the event that just one press machine is used for press working, the press working is limited by a case where its side face of the work is formed in a simple shape by conducting drawing simply or just holes are informed on its inclined face extending continuously from the upper face of the work.

Further, if it is necessary that further press working is conducted to the side face of the work extending vertically, the work needs to be transferred to another press machine comprising its own-designed dies and punches for further side-face press working. Thus, there were further problems that this additional step of press working would be necessary and additional costs for making these dies and this press working would be required.

Further, in the case of forming products with a relatively great depth by drawing, such as a door inner panel for vehicles, there may be a case where products with such desired depth could not formed by one press stroke of a press machine with upper and lower dies. In this case, it may be necessary that, firstly the first drawing is conducted to a sheet of panel by a certain press machine, next the panel is transfer to another press machine, and then subsequent steps of press working (for example, the second drawing step, drawing finishing step, or excising step) are conducted. In this case, however, when side-face press working is conducted to a side-face of the work (door inner panel for vehicles), the work needs to be transferred to the third press machine for the side-face press working as well. Thus, there was also a problem of the necessity of additional steps of press working, thereby complicated steps and cost increases.

SUMMARY OF THE INVENTION

The present invention has been devised in view of the above-described problems, and an object of the present invention is to provide a compound press-forming apparatus and a compound press-forming method that can reduce its working steps and its costs for making dies and press working, by not transferring the work to another press machine for its subsequent side-face press working in which press working is conducted to a side face of the work, but enabling the subsequent side-face press working to the work by means of a press machine that has conducted an upper/lower face press working to an upper/lower face of the work.

In order to achieve the above-described object, the first aspect of the present invention provides a compound press-forming apparatus including an upper die fixed to an elevated-side portion of a press machine that is moved up and down by an elevator, a lower die fixed to a fixed-side portion of the press machine, and working portions formed at respective corresponding portions of the upper and lower dies to conduct press working to a work jointly, comprising a side-face working apparatus that is disposed at the side of the lower die on the fixed-side portion of the press machine to conduct side-face press working to a side-face portion of the work jointly with the lower die, wherein the side-face working apparatus comprises a rotating base that is supported on the fixed-side portion of the press machine so as to rotate thereon, a reciprocating base that is supported on the rotating base so as to reciprocate thereon, a side-face working portion that is formed at an end portion of the reciprocating base to conduct side-face press working to the side-face portion of the work jointly with the lower die, and reciprocating driving means for moving the reciprocating base from an original position, in which the side-face working portion is away from the work, to a side-face press working position, in which the side-face press working is conducted to the work by the side-face working portion, and the side-face working apparatus is constituted such that it moves to an avoidance position, in which the side-face working apparatus is not in the way of the upper die going up and down, during the press working by the upper and lower dies, whereas it moves to a working capable position, in which the side-face press working is capable, after the upper die goes up, during the side-face press working by the side-face working portion and the lower die.

According to the first aspect of the present invention, the side-face press working can be conducted to the side-face of the work by the side-face working apparatus that is disposed at the side of the lower die. Thus, the work needs not to be transferred to another press machine for its side-face press working, but the side-face press working can be conducted by utilizing the same press machine that conducts the press working by the upper and lower dies, namely by the side-face working apparatus disposed on this press machine. Thereby, it can reduce the number of dies and costs for making dies and press working and provide an easy maintenance of dies.

Further, in this case, because the side-face working apparatus disposed at the side of the lower die of the press machine is constituted so as to move to the avoidance position in which it is not in the way of the upper die going up and down, the side-face working apparatus causes no problem to the press working done by the upper and lower dies.

The second aspect of the present invention provides the compound press-forming apparatus of claim 1, wherein the side-face working apparatus is constituted so as to move between the avoidance position and the working capable position according to the rotation of the rotating base of the side-face working apparatus.

According to the second aspect of the present invention, the movement of the side-face working apparatus between the avoidance position and the working capable position can be achieved easily and certainly by a simple way of the rotation of the rotating base that is supported on the fixed-side portion of the press machine.

The third aspect of the present invention provides the compound press-forming apparatus of claim 2, wherein the rotating base is supported on the fixed-side portion of the press machine through a bearing portion so as to rotate thereon, and comprises a driving apparatus that rotates the rotating base and a stopper that is disposed on the fixed-side portion of the press machine and supports the rotating base together with the bearing portion by making a top end thereof contact the rotating base, and the avoidance position of the side-face working apparatus is provided by rotating the rotating base to its substantially inverted position, whereas the working capable position of the side-face working apparatus is provided by rotating the rotating base to its laid position in which the rotating base is put on the stopper.

According to the third aspect of the present invention, the rotating base can be moved to the avoidance position and the working capable position of the side-face working apparatus and also supported thereto certainly and stably, by the driving apparatus that rotates the rotating base and the stopper that supports the rotating base at the side-face press working position.

The fourth aspect of the present invention provides the compound press-forming apparatus of claim 2, wherein the reciprocating driving means comprises a driving cam portion that includes a slant face disposed at the lower face of the upper die, a sliding cam-follower portion that is disposed at the upper face of the reciprocating base and constituted so as to slide by being pushed by the slant face of said driving cam portion when the upper die goes down according to the press machine's operation, and returning means that urges the reciprocating base to return from the side-face press working position to the original position on the rotating base and is constituted of a spring.

According to the fourth aspect of the present invention, because the side-face press working is conducted by utilizing the movement of the upper die going down, no additional driving resources for the side-face press working is necessary, resulting in efficient productivity and avoidance of large-scale apparatus.

The fifth aspect of the present invention provides the compound press-forming apparatus of claim 2, wherein the work to be conducted by the press working is a door inner panel for vehicles, steps of drawing and excising are conducted to a flat portion of the door inner panel by the press working of the upper and lower dies, whereas a step of excising is conducted to a side-face portion of the door inner panel by the side-face press working of the side-face working apparatus and the lower die.

According to the fifth aspect of the present invention, in forming the door inner panel for vehicles having the flat portion and the side-face portion, respective steps of press working that are desired for respective portions thereof can be conducted efficiently.

The sixth aspect of the present invention provides the compound press-forming apparatus of claim 5, wherein the side-face working apparatus is constituted so as to be disposed at least at three positions around the lower die to conduct press working to at least three side-face portions of the door inner panel, which are located at the sides of vehicle front, rear and lower, respectively.

According to the sixth aspect of the present invention, the side-face working apparatus disposed at least at three portions around the lower die can conduct the press working to the side-face portions of the door inner panel for vehicles efficiently.

The seventh aspect of the present invention provides a compound press-forming apparatus including an upper die fixed to an elevated-side portion of a press machine that is moved up and down by an elevator, a lower die fixed to a fixed-side portion of the press machine, and working portions formed at respective corresponding portions of the upper and lower dies to conduct press working to a work jointly, comprising a side-face working apparatus that is disposed at the side of the lower die on the fixed-side portion of the press machine to conduct side-face press working to a side-face portion of the work jointly with the lower die, wherein the side-face working apparatus comprises a rotating base that is supported on the fixed-side portion of the press machine so as to rotate thereon, a side-face working portion that is formed to conduct side-face press working to the side-face portion of the work jointly with the lower die, and oil-pressure driving means for moving the side-face working portion from an original position, in which the side-face working portion is away from the work, to a side-face press working position, in which the side-face press working, is conducted to the work by the side-face working portion, and the side-face working apparatus is constituted such that it moves to an avoidance position, in which the side-face working apparatus is not in the way of the upper die going up and down, during the press working by the upper and lower dies, whereas it moves to a working capable position, in which the side-face press working is capable, after the upper die goes up, during the side-face press working by the side-face working portion and the lower die.

According to the seventh aspect of the present invention, the same functions and effects as the first aspect of the present invention can be achieved by using the oil-pressure driving means.

The eighth aspect of the present invention provides the compound press-forming apparatus of claim 7, wherein the side-face working apparatus is constituted so as to move between the avoidance position and the working capable position according to the rotation of the rotating base of the side-face working apparatus.

According to the eighth aspect of the present invention, the same functions and effects as the second aspect of the present invention can be achieved.

The ninth aspect of the present invention provides the compound press-forming apparatus of claim 8, wherein the rotating base is supported on the fixed-side portion of the press machine through a bearing portion so as to rotate thereon, and comprises a driving apparatus that rotates the rotating base and a stopper that is disposed on the fixed-side portion of the press machine and supports said rotating base together with the bearing portion by making a top end thereof contact the rotating base, and the avoidance position of the side-face working apparatus is provided by rotating the rotating base to its substantially inverted position, whereas the working capable position of the side-face working apparatus is provided by rotating the rotating base to its laid position in which the rotating base is put on the stopper.

According to the ninth aspect of the present invention, the same functions and effects as the third aspect of the present invention can be achieved.

The tenth aspect of the present invention provides the compound press-forming apparatus of claim 8, wherein the oil-pressure driving means comprises a piston driving portion that is driven by oil pressure, a piston that is provided with the side-face working portion at an end thereof, and an oil-pressure controller that controls oil pressure supplied to the piston driving portion.

According to the tenth aspect of the present invention, the side-face press working by utilizing advantages of oil-pressure driving can be conducted adopting oil-pressure driving components like a piston and the like.

The eleventh aspect of the present invention provides the compound press-forming apparatus of claim 8, wherein the side-face working apparatus further comprises a reciprocating base that is supported on the rotating base so as to reciprocate thereon and provided with the side-face working portion at an end thereof, and the oil-pressure driving means comprises a piston driving portion that is driven by oil pressure, a piston rod whose one end is coupled to the piston driving portion and the other end is coupled to the reciprocating base, and an oil-pressure controller that controls oil pressure supplied to said piston driving portion.

According to the eleventh aspect of the present invention, the same functions and effects as the tenth aspect of the present invention. Further, stable and certain side-face press working can be achieved by utilizing the reciprocating base that is supported on the rotating base so as to reciprocate thereon.

The twelfth aspect of the present invention provides the compound press-forming apparatus of claim 8, wherein the work to be conducted by the press working is a door inner panel for vehicles, steps of drawing and excising are conducted to a flat portion of the door inner panel by the press working of the upper and lower dies, whereas a step of excising is conducted to a side-face portion of the door inner panel by the side-face press working of the side-face working apparatus and the lower die.

According to the twelfth aspect of the present invention, the same functions and effects as the fifth aspect of the present invention can be achieved.

The thirteenth aspect of the present invention provides the compound press-forming apparatus of claim 12, wherein the side-face working apparatus is constituted so as to be disposed at least at three positions around the lower die to conduct press working to at least three side-face portions of the door inner panel, which are located at the sides of vehicle front, rear and lower, respectively.

According to the thirteenth aspect of the present invention, the same functions and effects as the sixth aspect of the present invention can be achieved.

The fourteenth aspect of the present invention provides a compound press-forming method, in which a work is formed by an upper die fixed to an elevated-side portion of a press machine that is moved up and down by an elevator, a lower die fixed to a fixed-side portion of the press machine, and a side-face working apparatus disposed at the side of the lower die on the fixed-side portion of the press machine, comprising an upper/lower-face press working step of conducting press working to the work by moving down the upper die in cooperation with the lower die, and a side-face press working step of conducting side-face press working to a side-face portion of the work, which is subsequent to the upper/lower face press working step, by moving the side-face working apparatus after the upper die is moved up in cooperation with the lower die, wherein the side-face press working step comprises a positioning step in which the side-face working apparatus is moved from a moved-back position, in which the side-face working apparatus does not interfere with the upper die during the upper/lower-face press working step, to a position in a space formed above the lower die after the upper die is moved up so as to position the side-face working apparatus at the side of the lower die, and a working step in which the side-face press working is conducted to the side-face portion of the work that is put on the lower die after the upper/lower-face press working step is conducted.

According to the fourteenth aspect of the present invention, the side-face press working to the work can be conducted thorough these steps, and another press machine for conducting the side-face press working to the side face of the work is not necessary. Thus, it can improve the productivity without increasing working steps and reduce costs for making dies and press working.

Further, in this case, because the side-face working apparatus disposed at the side of the lower die of the press machine is constituted so as to move to the avoidance position in which it is not in the way of the upper die going up and down, this causes no problem to the press working done by the upper and lower dies.

The fifteenth aspect of the present invention provides the compound press-forming method of claim 14, wherein the work to be conducted by the press working is a door inner panel for vehicles, the upper/lower-face press working step includes steps of drawing and excising that are conducted to a flat portion of the door inner panel, whereas the side-face press working step includes a step of excising that is conducted to a side-face portion of the door inner panel.

According to the fifteenth aspect of the present invention, in forming the door inner panel for vehicles having the flat portion and the side-face portion, respective steps of press working that are desired for respective portions thereof can be conducted efficiently.

DETAILED DESCRIPTION OF THE INVENTION

Embodiment 1

Figure 1A:
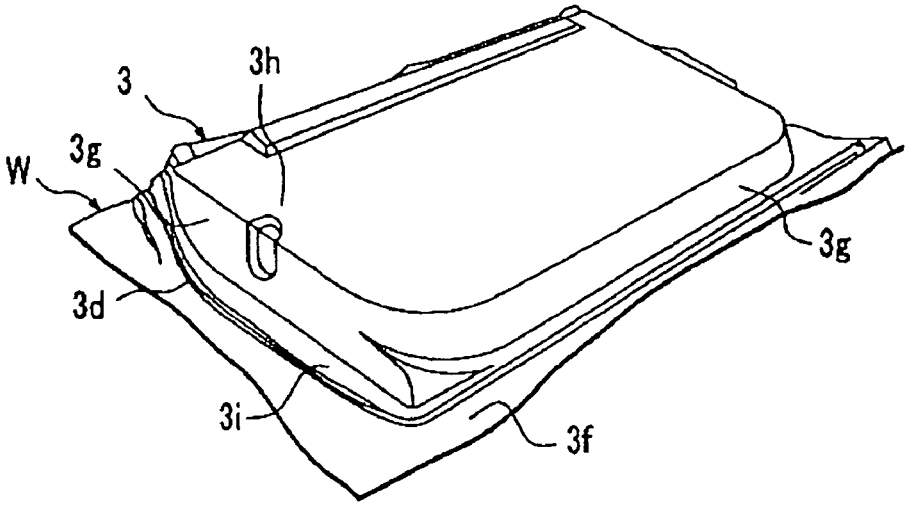
FIGS. 1(*a*) to 1(*c*) are views for showing the first embodiment of the present invention, and FIG. 1(*a*) is a perspective view for showing a work to which drawing/forming is conducted, FIG. 1(*b*) is a perspective view for showing the work to which flat-face piercing, trimming/slitting and listing are conducted, and FIG. 1(*c*) is a perspective view for showing the work to which side-face piercing/notching/burring and the like are conducted.
Figure 1B:
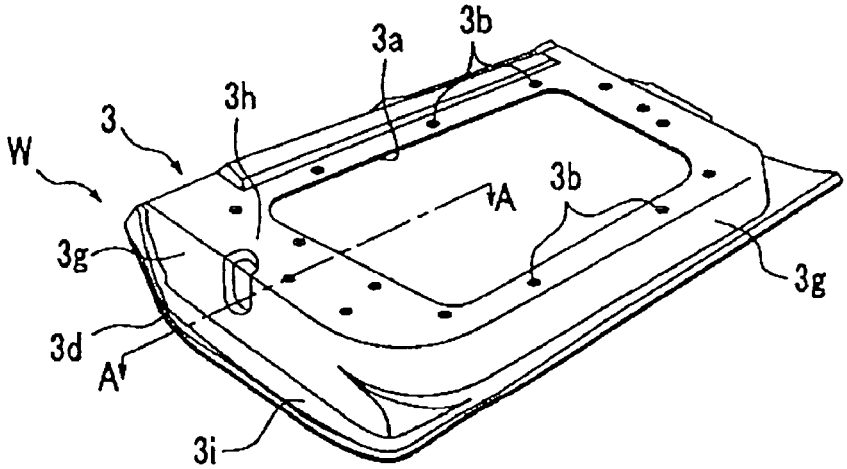
Figure 1C:
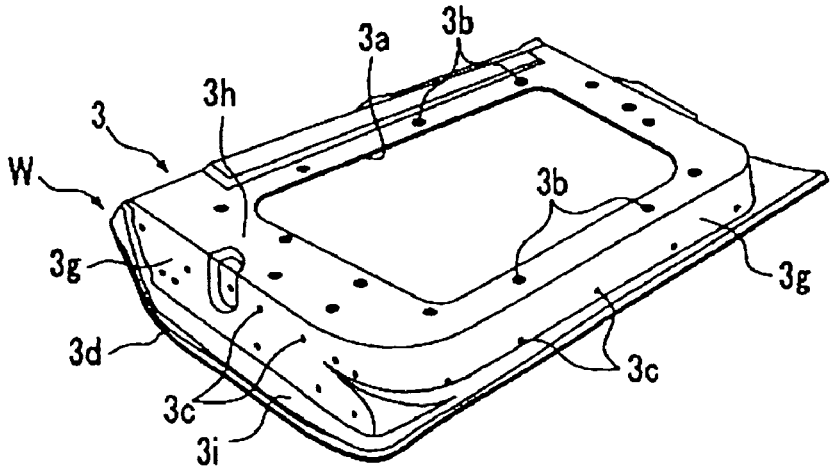
Figure 2A:
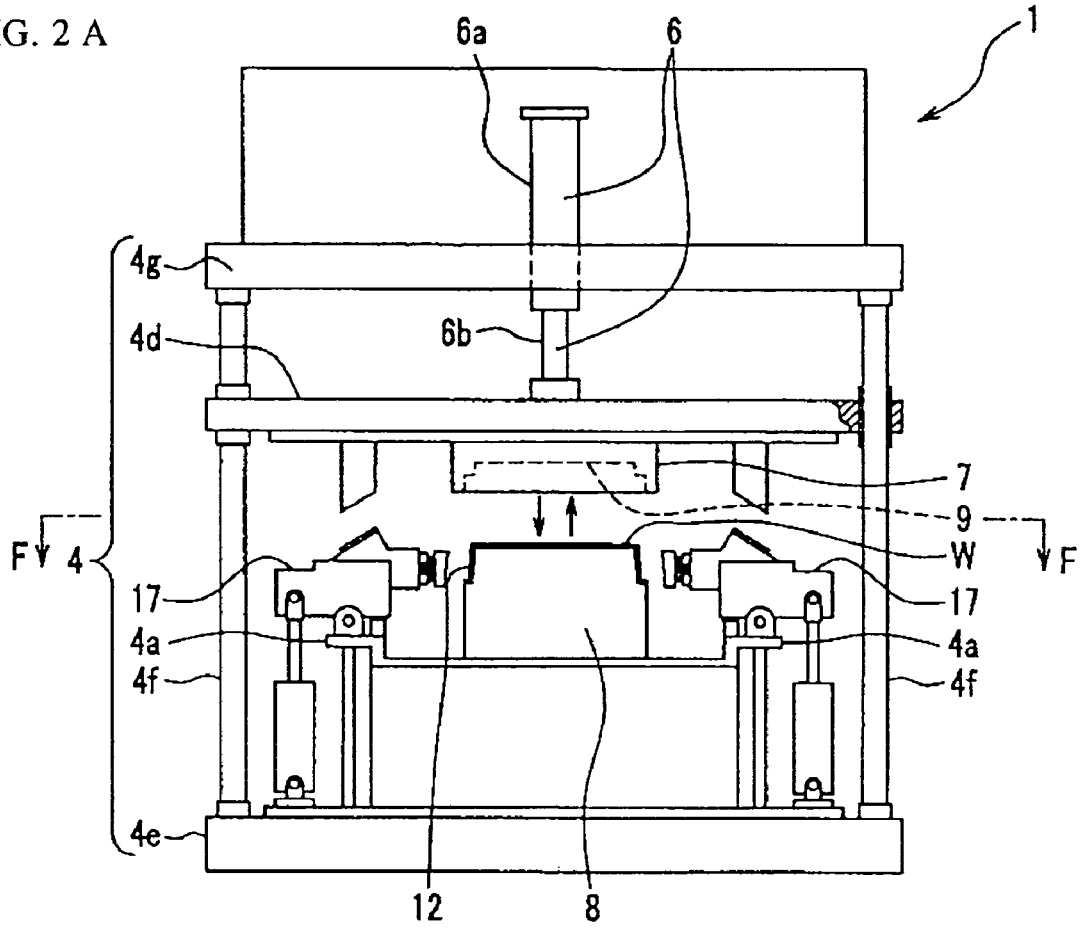
FIGS. 2(*a*) and 2(*b*) are schematic views for showing a compound press-forming apparatus according to the first embodiment of the present invention, and FIG. 2(*a*) is a plan view for showing structure of a press machine and FIG. 2(*b*) is a plan view for showing disposition relationships between the work and a side-face working apparatus seeing from a line F-F direction of FIG. 2(*a*).
Figure 2B:
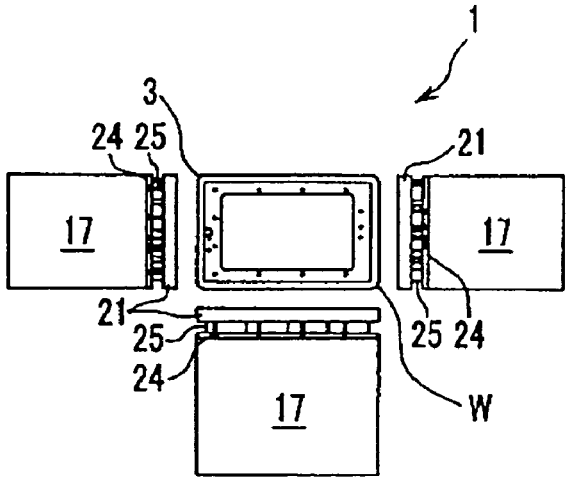

Hereinafter, the first embodiment of the present invention will be described with reference to FIGS. 1 to 6, with respect to an exemplified press forming of a door inner panel for vehicles. FIGS. 1(*a*) to 1(*c*) are views of works, to which press working are conducted by a press machine according to a compound press-forming apparatus of the present invention, and FIG 1(*a*) is a perspective view for showing the work to which drawing/forming (the first and second drawing steps) is conducted, FIG. 1(*b*) is a perspective view for showing the work to which listing (drawing finishing step) and flat-face piercing (making holes step), trimming/slitting (peripheral-edge cutting step) are conducted, and FIG. 1(*c*) is a perspective view for showing the work to which side-face piercing/notching/burring and the like (steps of making holes, cutting and the like) are conducted. FIGS. 2(*a*) and 2(*b*) are schematic views for showing the compound press-forming apparatus of the present invention, and FIG. 2(*a*) is a plan view of the press machine and FIG. 2(*b*) is a plan view for showing disposition relationships between the work and a side-face working apparatus seeing from a line F-F direction of FIG. 2(*a*). Herein, each step of drawing (the first drawing step), forming (the second drawing step), and listing (drawing finishing step) is one of so-called drawing steps of the press working, whereas each step of trimming (peripheral-edge cutting step), piercing (making holes step), notching (cutting step) and the like is one of so-called excising steps of the press working.

As shown in FIG. 2, a work W is pressed by an upper die 7 going down and a lower die 8 and applied plastic deformation thereto, thereby being formed into respective shapes of a inner panel 3 in order as shown in FIGS. 1(*a*) to 1(*c*). The work W, for example, is made of cold-rolling steel (SPC based) for drawing with a thickness of about 0.6 to 1.2 mm, which suits to materials for the inner panel 3.

The inner panel 3 includes a large trim-setting hole 3*a* for setting a door trim with an approximately square shape at the center portion thereof, flat-face piercing holes 3*b*, 3*b* . . . for setting plastic clips, rivets, screws and the like that attach a window regulator, a door-lock actuator and harness that are disposed inside the door or the door trim at a peripheral flat-face 3*h* around the trim-setting hole 3*a* thereof, cam piercing holes 3*c*, 3*c* . . . for setting plastic clips, rivets, screws and the like that attach a door-lock device, a glass-run channel retainer, hinges and the like that are disposed inside the door at side faces 3*g* thereof, and an outer-periphery trim 3*d* that is formed by cutting away an unnecessary portion 3*f* at the periphery thereof.

Figure 3:
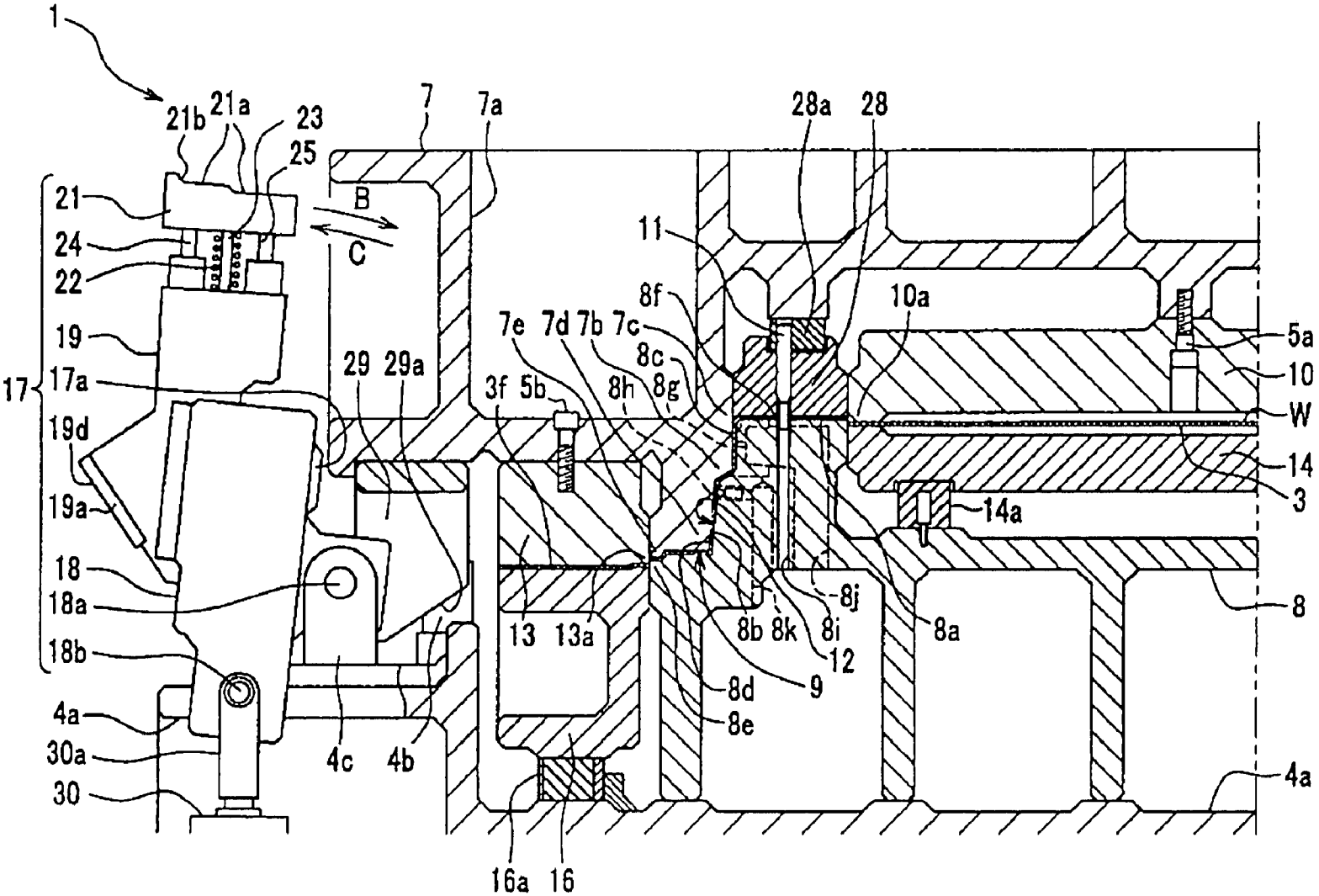
FIG. 3 is a partial enlarged-sectional view of the compound press-forming apparatus taken along line A-A of the work shown in FIG. 1*b*.
Figure 5:
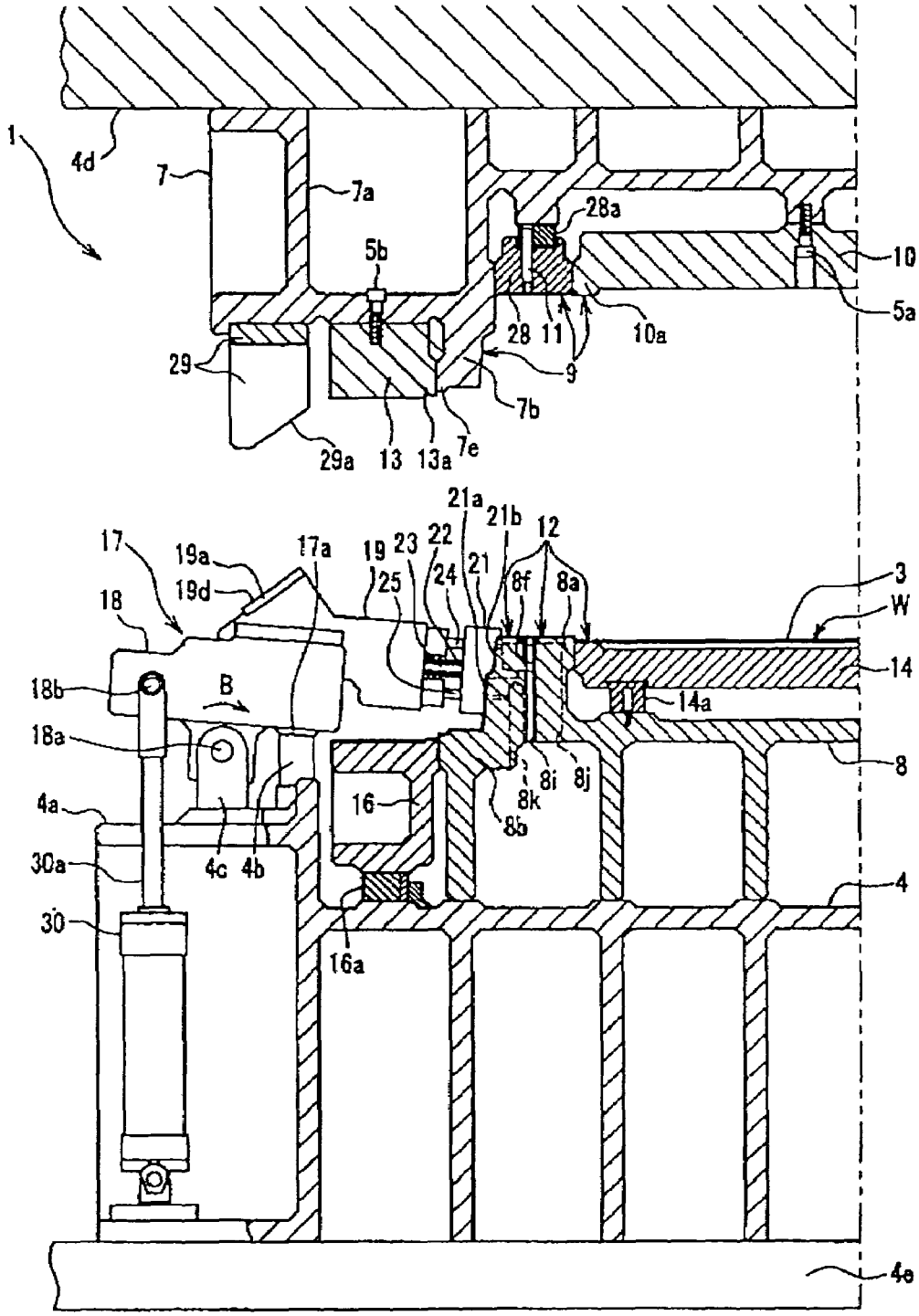
FIG. 5 is a partial enlarged-sectional half view of the compound press-forming apparatus for showing a state where a driving apparatus moves the side-face working apparatus to its horizontal position, according to the first embodiment of the present invention.

FIG. 3 is a partial enlarged-sectional view for showing structure of the compound press-forming apparatus of the present invention taken on line A-A of the work shown in FIG. 1(*a*). FIG. 5 is a partial enlarged-sectional half view of the compound press-forming apparatus for showing a state where a driving apparatus moves a side-face working apparatus to its horizontal position.

A press machine 1, as shown in, for example, FIGS. 2(*a*) and 2(*b*), includes an elevator 6 that moves up and down a ram 4*d* to which the upper die 7 is fixed, ram 4*d* that is fixed to the ram 4*d*, the upper die 7 that is fixed to the ram 4*d*, a forming punch 9 that conducts various kinds of press working, such as drawing, forming and listing, to the work W in cooperation with the upper die 7 and the lower die 8, the lower die 8 that is put on a table 4*a* of a body 4, a forming die 12 that is disposed at the lower die 8 facing to the forming punch 9, side-face working apparatuses 17, 17 . . . that are disposed at three places, namely at the right, left and lower of the work W on the forming die 12 (at the places so as to conduct press working to three side-face portions of the door inner panel which are located at the sides of vehicle front, rear and lower) (see FIG. 2(*b*)). The body 4 constitutes a framework of the press machine 1, and it includes a bed 4*e* as a base thereof and equipped with some members, which will be described below. Herein, the framework of the body 4 is not limited by a particular structure.

The elevator 6 is an oil-pressure driving mechanism that is constituted of an oil cylinder 6*a* disposed at an upper base 4*g* of the body 4 located at the upper and center of the, press machine 1, in which an oil is supplied by an oil pump, not shown in any drawing, and a piston rod 6*b* thereof acts to be capable of expansion and contraction. The ram 4*d* is coupled to an end of the piston rod 6*b* and is moved up and down, being guided by a guide post 4*f*, by the expansion and contraction of the piston rod 6*b*.

Herein, the elevator 6 is not limited to a particular oil-pressure cylinder, but other structure may be adopted.

Figure 4:
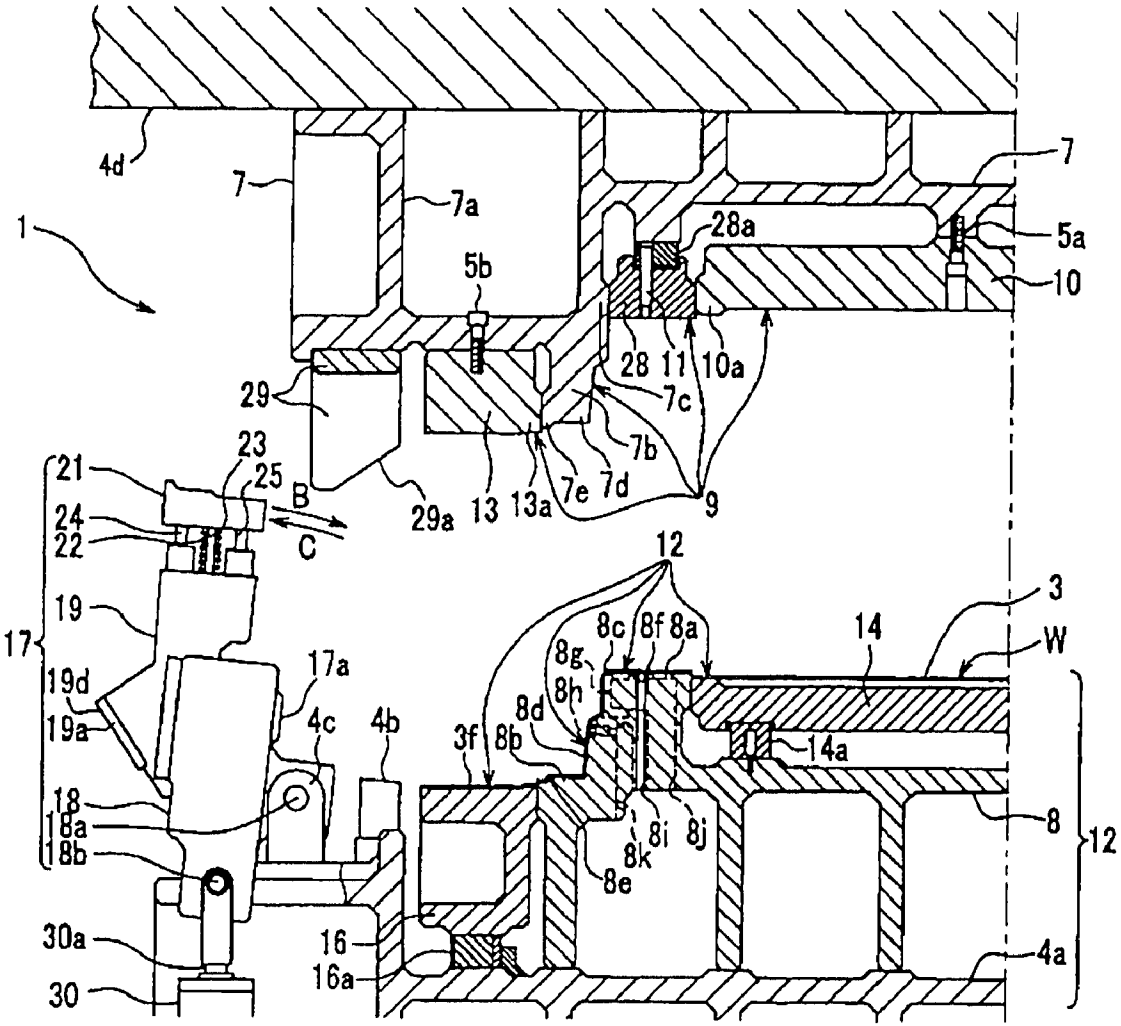
FIG. 4 is a partial enlarged-sectional half view of the compound press-forming apparatus for showing a state where an upper die goes up, according to the first embodiment of the present invention.

FIG. 4 is a partial enlarged-sectional half view of the compound press-forming apparatus for showing a state where the upper die goes up.

As shown in FIG. 4, the upper die 7 includes the forming punch 9 for conducting drawing, forming and listing, upper die-side cutting edges 13*a*, 13*a* . . . for conducting trimming, and flat-face piercing punches 11, 11 . . . for conducting flat-face piercing, to respectively the work W in cooperation with the lower die 8.

At the lower face of the upper die 7, a listing punch 7*b* for pushing the work W to a listing die 8*b* is formed to be integrated with the upper die 7. Further, a large piercing punch 10 for conducting trimming, a cutting edge 13 including the above-described upper die-side cutting edge 13*a*, and a pad 28 including above-described flat-face piercing punches 11 are disposed side by side and they are fixed by bolts 5*a*, 5*a* . . . to the lower face of the upper side 7, which are moved up and down along with the ram 4*d* by the elevator 6.

The forming punch 9 is constituted of the listing punch 7*b*, the large piercing punch 10, the pad 28, the flat-face piercing punches 11 and the cutting edge 13, which are made from, for example, gray cast iron (FC) or the like. The forming punch 9 can conduct a plurality of working, including drawing, forming and listing, to the work W at the same time in cooperation of the upper die 7 and the lower die 8.

The upper die-side cutting edge 13*a* is formed at the lower and inner side of the cutting edge 13, and conducts peripheral-edge cutting (trimming) by cutting the unnecessary portion 3*f* of the inner panel 3 in corporation with a lower die-side cutting edges 8*e* that are formed at the lower die 8 (see FIG. 1(*b*)).

The cutting edge 13 is fixed to the upper die 7 at the outside of the listing punch 7*b* by a plurality of bolts 5*b*, 5*b*. . . . The cutting edge 13 has the function of holding the work W together with a blank holder 16 (hereinafter, referred to as holder, simply) that is pressed by a cushion pin with locking device 16*a* (hereinafter, referred to as cushion pin, simply) and the function of cutting the unnecessary portion 3*f* around the inner panel 3 by the upper die-side cutting edge 13*a*. The bolts 5*b* are inserted from the side of an upper die outer 7*a* that is formed at upper face of the upper die 7.

The flat-face piercing punch 11 is constituted so as to project from the lower face of the pad 28, by its going down with the upper die 7 and letting the pad 28 pressing a return spring 28*a* according to the movement of the elevator 6. The flat-face piercing punch 11 presses the work W until its inserting into a punch hole 8*f* of a flat-face piercing die 8*a*, thereby conducting piercing (making holes) to make a plurality of flat-face piercing holes 3*b* to the work W. Unnecessary scraps of the work W cut out by the flat-face piercing punch 11 are discharged from a passage 8*i* of the flat-face piercing die 8*a* to the lower part of the lower die 8. Herein, the number and the scale of the flat-face piercing punches 11, 11 . . . may be chosen properly depending on the flat-face piercing holes 3*b*, 3*b* . . . formed at the inner panel 3.

The pad 28 is disposed so as to move up and down between the listing punch 7*b* and the large piercing punch 10 of the upper die 7, and it is provided with a plurality of flat-face piercing punches 11, 11 . . . facing to the flat-face piercing die 8*a* at the center thereof. The pad 28 goes down along with the upper die 7, to which it is fixed through the return spring 28*a*, and prevent any creases from occurring during piercing by pressing the work W with the flat-face piercing die 8*a*.

The spring 28*a* is made of, for example, urethane rubber, and constituted such that each of the flat-face piercing punches 11, 11 . . . projects from the lower face of the pad 28 by being pushed by the upper die 7 when the return spring 28*a* is compressed by a predetermined magnitude of pressure of load or more. Herein, the return spring 28*a* may be made of gas spring, instead of urethane rubber.

The listing punch 7*b* goes down along with the upper die 7, and draws a portion around the flat face 3*h*, at which the flat-face piercing holes 3*b*, 3*b* . . . of the inner panel 3 are formed, together with the listing die 8*b* of the lower die 8 to provide its desired depth and its corners of the desired radius-magnitudes, resulting in conducting drawing/forming and listing (finishing drawing) that finishes a surface of a flange 3*i*. Thus, most part of face forming of the inner panel 3 is done.

The large piercing punch 10 is fixed to the lower face of the upper die 7 through bolts 5*a*, 5*a* . . . and punches the work W together with a large piercing die 14 disposed at the lower die 8 to conduct making-hole working (piercing) of forming the trim-setting hole 3*a* for setting the door trim at the inner panel 3. The large piercing punch 10 is moved down together with the upper die 7 by the elevator 6, and presses the work W on the large piercing die 14 against a return spring 14*a*, which is made of gas spring or the like, until its contacting the flat-face piercing die 8*a*, resulting in forming the trim-setting hole 3*a* by cutting out the work W by a cutter portion 10*a* of an outer edge of the large piercing punch 10.

The lower die 8 is provided with the forming die 12 corresponding to the forming punch 9, the lower die-side cutting edges 8*e* and the flat-face piercing die 8*a*, which are disposed at the forming die 12, and the holder 16 supporting the work W.

The forming die 12 includes the large piercing die 14 disposed facing to the large piercing punch 10, the flat-face piercing die 8*a* disposed facing to the pad 28, the listing die 8*b* disposed facing to the listing punch 7*b*, side-face piercing dies 8*c*, 8*d* disposed facing to a pad 21 of the side-face working apparatus 17, and the holder 16 disposed facing to the cutting edge 13. The forming die 12 constitutes the upper face of the lower die 8. The lower die 8 includes the flat-face piercing die 8*a*, the listing die 8*b*, the side-face piercing dies 8*c*, 8*d*, and the lower die-side cutting edge 8*e*, in one united body.

The large piercing die 14 is disposed at the lower die 8 in a state where it is pressed upwardly by the return spring 14*a*. The return spring 14*a* is constituted of an elastic member, such as urethane rubber, spring or gas spring.

The holder 16 constitutes a holding mechanism that holds the outer peripheral portion of the work W together with the cutting edge 13 of the upper 7. The holder 16 constituting a part of the holding mechanism is disposed through the cushion pin 16*a* in such manner that it goes down with a predetermined magnitude of load or more.

Figure 6:
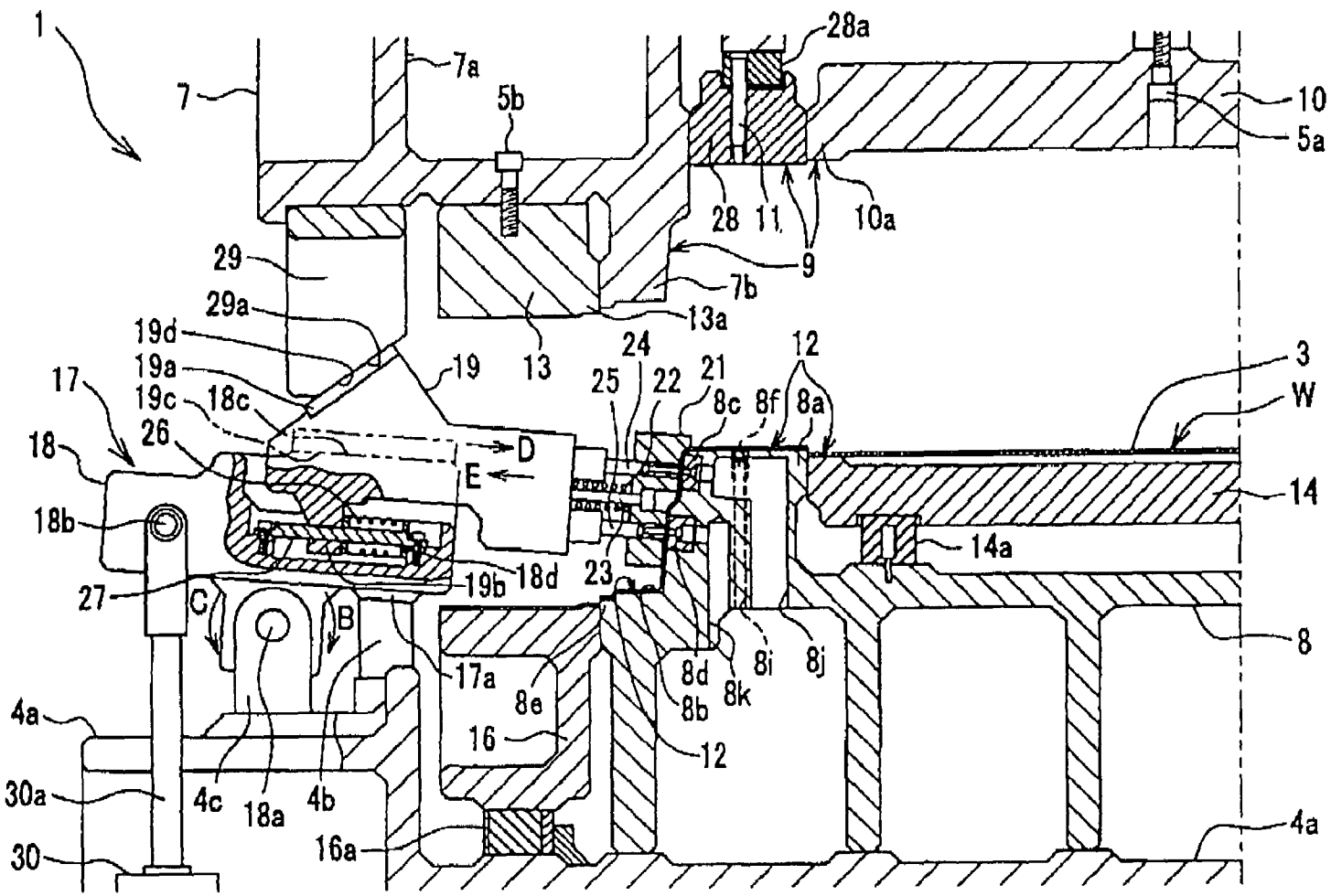
FIG. 6 is a partial enlarged-sectional half view of the compound press-forming apparatus for showing a state where the working by the side-face working apparatus is conducted, according to the first embodiment of the present invention.

FIG. 6 is a partial enlarged-sectional half view of the compound press-forming apparatus for showing a state where the working by the side-face working apparatus is conducted.

As shown in FIG. 6, the side-face working apparatuses 17, 17 . . . are machines that conduct side-face working of piercing and the like (excising), which are located at three peripheral-sides of the lower die 8, respectively. The side-face working apparatus 17 includes a rotating base 18 that is supported on the table 4*a*, reciprocating driving means that is disposed on the rotating base 18 so as to slide and reciprocates a reciprocating base 19, the reciprocating base 19 that is disposed on the rotating base 18 so as to reciprocate, a plurality of side-face piercing punches 24, 24 . . . , 25, 25 . . . that make holes of a plurality of cam piercing holes 3*c*, 3*c* . . . (see FIG. 1(*c*)), and the pad 21.

The side-face working apparatus 17 is disposed, for example, on the table 4*a* at a position that is outside from the lower die-side cutting edge 8*e* forming the outer-periphery trim 3*d* of the inner panel 3. The table 4*a* is provided thereon with a bearing portion 4*c* that supports an axis portion 18*a* disposed at the center of the lower face of the side-face working apparatus 17 so that the axis portion 18*a* can rotate, and a stopper 4*b* that projects so as to support the side-face working apparatus 17 at its certain inclined position. The side-face working apparatus 17 includes a driving apparatus 30 that operates by oil pressure or the like, and an outer end thereof is coupled to a cylinder rod 30*a* of the driving apparatus 30, so that it rotates around the axis portion 18*a* in the arrow directions B, C according to the expansion and contraction of the cylinder rod 30*a*.

The rotating base 18 includes the reciprocating driving means disposed at about center portion thereof, return means for automatically returning the reciprocating base 19, which constitutes a part of the reciprocating driving means, in the arrow direction E, the axis portion 18*a* for the center of rotation thereof, a coupling portion for cylinder rod 18*b* disposed at an end thereof, and the reciprocating base 19 supported on the a slide surface 18*c* of the rotating base 18 so as to slide.

The reciprocating driving means is to move the reciprocating base 19 toward the side-face piercing dies 8*c*, 8*d*, and includes the elevator 6 as driving forces (see FIG. 2(*a*)), a driving cam 29 that is disposed at the lower face of the upper die 7 elevated by the elevator 6, a sliding cam follower 19*a* that slides by being pushed by a slant face 29*a* of the driving cam 29, the reciprocating base 19 integrated to the sliding cam follower 19*a*, and the returning means to return automatically the reciprocating base 19 to an original position thereof.

The sliding cam follower 19*a* includes a slant face 19*d* with an inclined angle of about 45 degree that is formed at the upper face of the reciprocating base 19, and the slant face 29*a* of the driving cam 29 fixed to the lower face of the upper die 7 goes down and contacts the slant face 19*d* of the sliding cam follower 19*a*, so that the reciprocating base 19 can slide toward a arrow direction D by being pushed by the slant face 29*a*. Herein, a force of longitudinal direction is changed to the one of lateral direction.

The reciprocating base 19 includes the sliding cam follower 19*a*, a spring receiver 19*b*, a plurality of side-face piercing punches 24, 25, the pad 21 that supports the side-face piercing punches 24, 25, a spring 22 that presses the pad 21 and moves back when the pad 21 receives a certain magnitude of pressure or more. Herein, the spring 22 is disposed around a rod 23 that supports the pad 21 in such manner that the pad 21 moves forward and back. The reciprocating base 19 is disposed on the sliding face 18*a* of the rotating base 18 through a sliding face 19*c* so as to slide thereon, and moves forward along with the side-face piercing punches 24, 24 . . . , 25, 25 . . . by the driving cam 29 contacting the sliding cam follower 19*a* formed at the upper face thereof.

The returning means is to return the rotating base 19 toward the connecting portion 18*b* with the cylinder rod 30*a*, and constituted of, for example, a coil spring 26. In the returning means, the coil spring 26 is inserted in a guide 27 that is fixed to the rotating base 18, whose one end is pressed against a spring receiver 18*d* of the rotating base 18 and the other end is pressed against the spring receiver 19*b* of the reciprocating base 19, and thereby the reciprocating base 19 that has moved toward the arrow direction D is automatically returned toward the arrow direction E to its original position. Herein, the returning means may be constituted in other ways.

The side-piercing punches 24, 25 punch a plurality of cam piercing holes 3*c*, 3*c* . . . at the side-face 3*g* of the work W (see FIG. 1(*c*)) by hitting into punching holes 8*g*, 8*h* of the side-face piercing dies 8*c*, 8*d* disposed at the die face of the lower die 8 (see FIG. 4). Unnecessary scraps that are cut out from the work W by the side-piercing punches 24, 24 . . . , 25, 25 . . . are discharged from the punching holes 8*g*, 8*g* . . . 8*h*, 8*h* . . . of the listing die 8*b* to the lower part of the lower die 8 through passages 8*j*, 8*j* . . . , 8*k*, 8*k*. . . . Herein, the number and the scale of the side-piercing punches 24, 24 . . . , 25, 25 . . . may be chosen properly depending on the cam piercing holes 3*c*, 3*c* . . . formed at the inner panel 3 (see FIG. 1(*c*)).

The pad 21 is disposed, as shown in drawings, so as to move forward and back to the side-piercing punches 24, 24 . . . , 25, 25 . . . and the rod 23 around which the spring 22 is placed. The pad 21 allows the plurality of side-piercing punches 24, 24 . . . , 25, 25 . . . to project from the end face of the pad 21 by moving back against the spring 22 to the side-piercing punches 24, 25 and the rod 23, so that they conduct making holes (piercing) and cutting (notching) to the side face 3*g* of the work W. The pad 21 has the function of pushing the work W against the side-piercing punches 24, 24 . . . , 25, 25 . . . and the side-face piercing dies 8*c*, 8*d*, and the function of easily separating the side-piercing punches 24, 24 . . . , 25, 25 . . . from the side-face piercing dies 8*c*, 8*d* and the work W. As shown in FIGS. 3, 4 and 5, the pad 21 includes a side-portion pushing face 21*a* to push the side face of the work W and an upper-portion pushing face 21*b* to push an upper face of the work W so as to provide an accurate positioning of the work W to the lower die 8.

Next, a method for conducting a compound press forming to the work W by using the press machine 1 will be described.

In the first step, as shown in FIG. 3, the upper die 7 and the lower die 8 are moved relatively to approach each other by the elevator 6, and the cutting edge 13, the listing punch 7*b* and the large piercing punch 10 of the upper die 7 press the work W placed on the lower die 7 to conduct drawing/forming thereto.

In the first step, the listing punch 7 goes down approaching the lower die 8, and accordingly the first curving cutter 7*c* of the listing punch 7*b* bends the work W together with the flat-face piercing die 8*a*, and the listing punch 7*b* and the listing die 8*b* jointly draw the side face 3*g* of the work W to conduct drawing (drawing/forming). The second curving cutter 7*d* and the listing die 8*b* jointly conduct bending to form the flange 3*i* of the inner panel 3. Accordingly, the work W is formed in a shape shown in FIG. 1(*a*).

In the second step, the upper die 7 further goes down toward the lower die 8 by the operation of the elevator 6 pressing the work W, and thereby the work W is drawn so as to have an its desired depth (namely, forming step) and it is also formed so as to have its corners of desired radius-magnitudes (namely, listing step).

During the second step, by reducing the distance between the upper die 7 and the lower die 8 by the elevator 6, steps of outer-periphery trimming, outer periphery listing and flat-face piercing are conducted to the work W. The cutting edge 13 conducts shearing (trimming) to the work W by pressing down the work W and the holder 16 against the cushion pin 16*a*, in which the unnecessary portion 3*f* of the inner panel 3 (see FIG. 1(*b*)) is cut away as scraps by the upper die-side cutting edge 13*a*.

During the second step, the upper die 7 goes down and the pad 28 supporting the flat-face piercing punch 11 presses the return spring 28*a*, and thereby the flat-face piercing punch 11 projects from the lower face of the pad 28 and punches the work W to form the flat-face piercing hole 3*b*. Thus, flat-face piercing is conducted.

During the second step, the large piercing punch 10 goes down toward the lower die 8 along with the upper die 7, and moves the work W and the large piercing die 14 down against the return spring 14*a*. Thereby, the cutter portion 10*a* conducts piercing to make the trim-setting hole 3*a* of the work W. Accordingly, the work W is formed as shown in FIG. 1(*a*).

In this way, an upper/lower-face press working step including the above-described first and second steps by the upper die 7 and the lower die 8 is done. In this embodiment, a pair of dies, the upper die 7 and the lower die 8, can conduct a plurality of press-working at one time.

Further, as shown in FIG. 4, when the upper die 7 is elevated by the elevator 6, the return spring 14*a* pushes up the scraps cut out by the large piercing punch 14 so as to hold then in a state where workers, or machines like robots can take them out easily. Meanwhile, the cushion pin 16*a*, effecting its temporary lock function, enables the holder 16 to stay at its lowest position so as to prepare for receiving the side-face working apparatus 17.

The holder 16 goes up to its highest position with the lock released when the side-face working apparatus 17 returns to its original position.

Subsequently, steps of side-face press working are conducted which are constituted of the third step (positioning step) and the fourth step (working step) by the lower die 8 and the side-face working apparatus 17, 17. . . .

In the third step (positioning step), the side-face working apparatus 17, 17 . . . is positioned at a certain position. Namely, firstly as shown in FIG. 4, after the side-face working apparatus 17, 17 . . . is moved to its avoidance position in which the side-face working apparatus is not in the way of the upper die 7, the upper die 7 is lifted up away from the lower die 8 by the elevator 6 so that the side-face working apparatus 17, 17 . . . can be positioned between the lower die 8 and the upper die 7.

Next, as shown in FIG. 5, the side-face working apparatus 17 is turned around the axis portion 18*a* in the arrow direction B toward the listing die 8*b*, by the cylinder rod 30*a* of the driving apparatus 30 pushed out. The turned side-face working apparatus 17 stops when its contact portion 17*a* contacts the stopper 4*b*, so that it is set at substantially horizontal position with its side of the side-face piercing punches 24, 24 . . . , 25, 25 . . . lowered a bit. The pad 21 is extended to the side face of the work W and then positions the work W. Accordingly, the side-face working apparatus 17 contacts the side face 13*g* of the work W set on the lower die 8, and is positioned so that the cam piercing holes 3*c*, . . . can be formed on the side face 13*g* of the work W by the side-face piercing punches 24, 24 . . . 25, 25. . . . Namely, the side-face working apparatus 17 is moved from its avoidance position, in which it does not interfere with the upper die 7 going up and down (see FIG. 4), to its working capable position, in which the side-face press working is capable (see FIG. 5), after the upper die 7 goes up.

Next, in the forth step, piercing and notching (excising) that form the cam piercing holes 3*c*, 3*c* . . . at the side face 3*g* of the work W (see FIG. 1(*c*)) are conducted.

In the forth step, firstly, the upper die 7 is moved down by the elevator 6 (see FIG. 2(*a*)). Then, as shown in FIG. 6, the driving cam 29 goes down and contacts the slant face 19*d* of the sliding cam follower 19*a*. The reciprocating base 19 of the side-face working apparatus 17 is pushed and the sliding face 19*c* thereof slides on the sliding face 18*c*, so that the reciprocating base 19 moves on the rotating base 18 in the arrow direction D, the substantially horizontal direction. The pad 21 and the side-face piercing punches 24, 24 . . . , 25, 25 . . . move in the arrow direction D along with the reciprocating base 19, and at first only the pad 21 presses the work W against the side-face piercing dies 8*c*, 8*d*.

When the driving cam 29 goes down more by the operation of the elevator 6 and the reciprocating base 19 moves in the arrow direction D, the pad 21 compresses the spring 22 and thereby the side-face piercing punches 24, 25 project from the pad 21 to punch the portion of the work W on the side face of the side-face piercing dies 8*e*, 8*d*, resulting in conducting piercing/notching working. At this time, the pad 21 holds the work W at its position by compressing the spring 22. The side-face piercing punches 24, 24 . . . , 25, 25 . . . punch the work W into the punching holes 8*g*, 8*g* . . . , 8*h*, 8*h* . . . (see FIG. 4) to form the cam piercing holes 3*e*, 3*c* . . . (FIG. 1(*c*)). Scraps of the work W punched out by the side-face piercing punches 24, 24 . . . drop through the passages 8*j*, 8*j* . . . formed at the side-face piercing die 8*c* to the lower part of the lower die 8. Meanwhile, scraps of the work W punched out by the side-face piercing punches 25, 25 . . . drop through the passages 8*k*, 8*k* . . . formed at the side-face piercing die 8*d* to the lower part of the lower die 8.

When the driving cam 29 goes up away from the sliding cam follower 19*a* by the operation of the elevator 6, the reciprocating base 19 is moved back to its original position by the coil spring 26 pressed against the spring receiver 19*b*. The reciprocating base 19 moves in the arrow direction E, and thereby the side-face piercing punches 24, 24 . . . , 25, 25 . . . are away from the work W. Then, the pad 21 moves according to the spring 22 and stops at a position in which it contacts a head portion of the rod 23 (see the drawings). Thus, the state comes back to the original one where the end portions of the side-face piercing punches 24, 24 . . . , 25, 25 . . . are in the pad 21.

In the forth step, when the side-face piercing punches 24, 24 . . . , 25, 25 . . . press the work W from the side direction to punch thereon, the side-face working apparatus 17 is supported at four points, namely by the driving cam 29, the stopper 4*b*, the axis portion 18*a* and the connecting portion 18*b* with the cylinder rod 30*a*. Accordingly, the side-face working apparatus 17 can be supported stably without any effect by the reaction of side-face piercing punches 24, 24 . . . , 25, 25 . . . , and thereby accurate working face of the work W can be obtained. Thus, the side-face press working to the work W is completed and the inner panel shown in FIG. 3 is obtained.

Embodiment 2

Next, the second embodiment of the present invention will be described.

Figure 7:
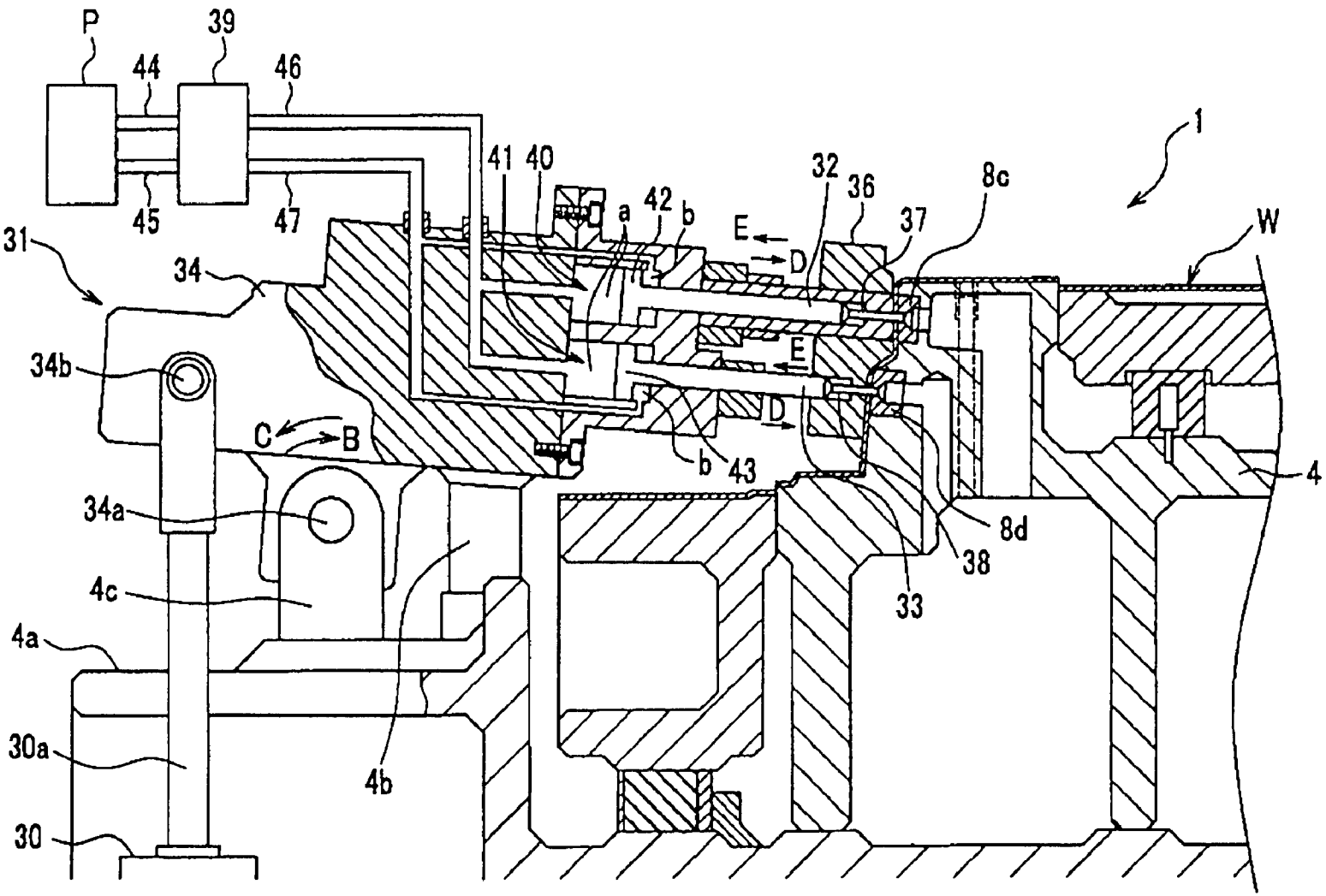
FIG. 7 is a schematic view for showing a side-face working apparatus equipped with operating mechanisms according to the second aspect of the present invention.

FIG. 7 is a schematic view for showing a side-face working apparatus equipped with operating mechanisms according to the second embodiment.

Herein, the same parts as those of the first embodiment will be denoted by the same reference numerals without any detailed description thereof. In a side-face working apparatus 31 of the second embodiment, oil-pressure driving means that is consisted of oil-pressure devices and the like is disposed directly on a rotating base 34 so that side-face piercing punches 32, 33 can be moved back and forth. Herein, the side-face piercing punches 32, 33 are constituted of seven and four, in total eleven punches.

The side-face working apparatus 31 includes the rotating base 34 that is disposed on the table 4*a* of the body 4, oil-pressure diving means that is disposed on the rotating base 34 and reciprocates the side-face piercing punches 32, 32 . . . 33, 33 . . . , the side-face piercing punches 32, 32 . . . 33, 33 . . . that conduct forming of the cam piercing holes 3*c*. . . , and a pad 36 that the side-face piercing punches 32, 32 . . . 33, 33 . . . are provided with.

The rotating base 34 is disposed on the table 4*a* of the body 4 so that it can rotate around an axis portion 34*a*. On the table 4*a*, the bearing portion 4*c* that supports the axis portion 34*a* disposed at the center of the lower face of the side-face working apparatus 31 so that the side-face working apparatus 31 can rotate in the arrow directions B, C, and the stopper 4*b* that prevents the side-face working apparatus 31 from rotating more than a desired angle are provided. The rotating base 34 is rotated around the axis portion 34*a* in the arrow directions B, C by the extension/contraction vertical movement of the cylinder rod 30*a* of the driving apparatus 30, which is coupled to an outer end of the rotting base 34. When the side-face working apparatus 31 rotates in the arrow direction B, the pad 36 and the side-face piercing punches 32, 33 approach the work W, thereby providing a working capable position. The rotating base 34 includes the side-face piercing punches 32, 33, reciprocating driving means, the axis portion 34*a*, and a connecting portion 34*b* with cylinder rod disposed at one end thereof.

The oil-pressure driving means moves the side-face piercing punches 32, 33 back and forth toward the listing die 8*b*, and it is constituted of a fluid-pressure apparatus with oil. The oil-pressure driving means includes, for example, an oil-pressure driving source P, an oil-pressure controller 39 that controls oil pressure of the oil-pressure driving source P, piston drivers 40, 41 that move the side-face piercing punches 32, 33 by the oil pressure from the oil-pressure controller 39, and pistons 42, 43 that are formed at base end portions of the side-face piercing punches 32, 33.

The oil-pressure driving source P is disposed outside of the side-face working apparatus 31 and supplies high-pressure oil to the oil-pressure controller 39 through an oil-pressure hose 44. Switching on/off of the oil is done at the oil-pressure controller 39, and the side-face piercing punches 32, 33 are pushed out by supplying high-pressure oil into respective cylinders a of the piston drivers 40, 41 through an oil-pressure hose 46. On the contrary, the side-face piercing punches 32, 33 are returned to their original positions by supplying lower-pressure oil into respective cylinders b of the piston drivers 40, 41 through oil-pressure hoses 47, 45.

In this way, working of making holes (piercing) and cutting (notching) can be conducted to the side face 3*g* of the work W by the reciprocating movement of the side-face piercing punches 32, 33 moving back and forth. In this embodiment, the pad 36 is fixed to the rotating base 34 with a constant distance between the rotating base 34 (as shown in the drawing, it is connected though a cylinder enclosing the periphery of the side-face piercing punches 32). However, this is not limited by a particular structure, but the same structure as that previously described may be adopted.

As described above, when conducting the press working by the side-face working apparatus 31, piercing for forming the cam piercing holes 3*c*, 3*c* on the work W is done by controlling the oil-pressure from the oil-pressure driving source P by the oil-pressure controller 39 and pushing out the side-face piercing punches 32, 32 . . . 33, 33 . . . against the work W.

Embodiment 3

Next, a side-face working apparatus according to the third embodiment of the present invention will be described.

Figure 8:
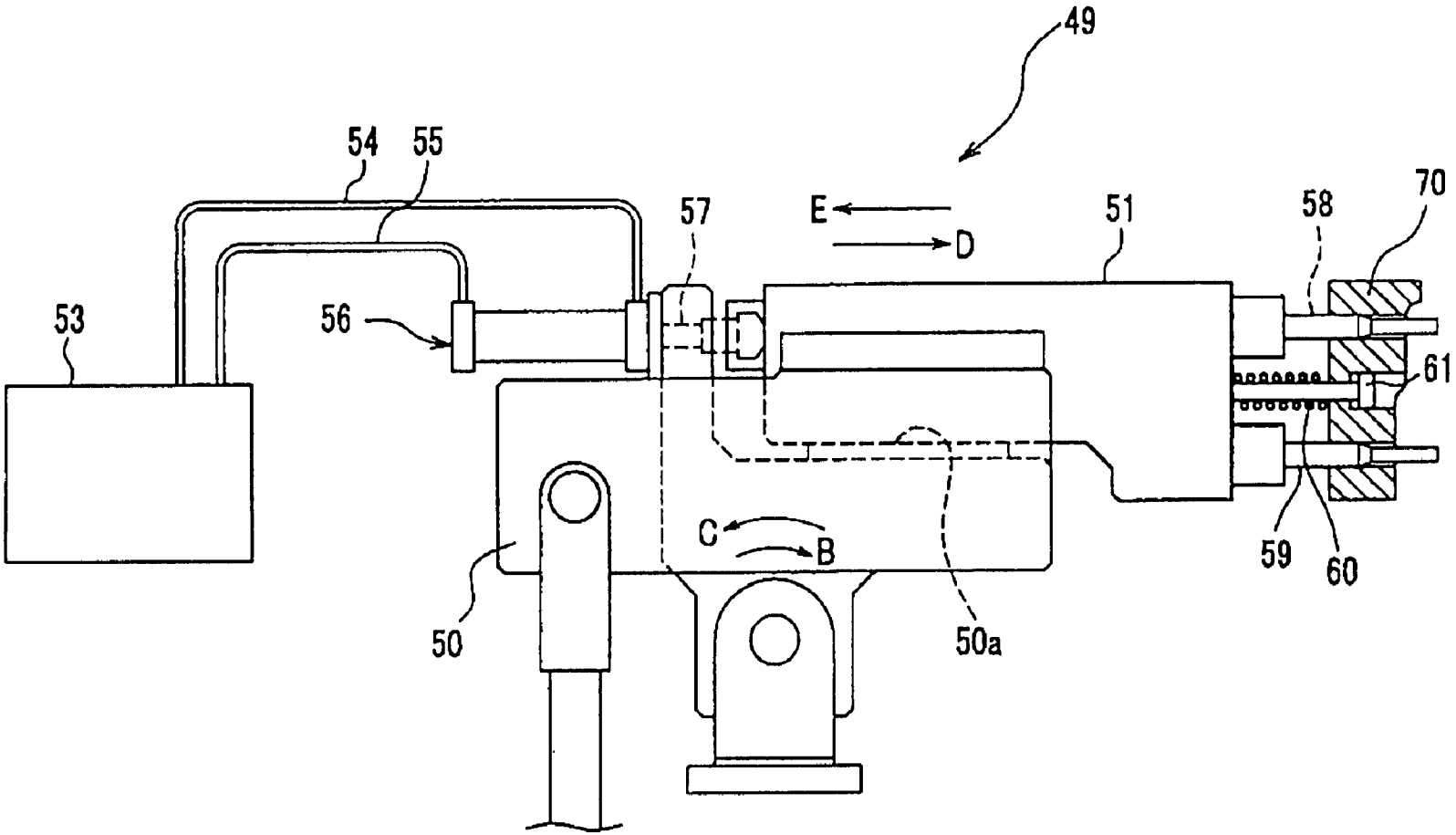
FIG. 8 is a schematic view for showing a side-face working apparatus equipped with operating mechanisms according to the third aspect of the present invention.

FIG. 8 is a schematic view for showing the side-face working apparatus equipped with operating mechanisms according to the third embodiment. In a side-face working apparatus 49 of the third embodiment, a reciprocating base is disposed on a rotating base so as to reciprocate thereon like the first embodiment, and a side-face working portion to conduct side-face press working is moved by oil-pressure driving means to operate by oil pressure like the second embodiment.

Specifically, as shown in FIG. 8, the side-face working apparatus 49 includes, like the first embodiment, a rotating base 50 that is disposed on the table 4*a* which is a fixed-side portion of the press machine, and a reciprocating base 51 that is supported on the rotating base 50 through a supporting portion 50*a* so as to reciprocate thereon, and it also includes side-face piercing punches 58, 58 . . . , 59, 59 . . . , a pad 70, a spring 60 and a rod 61, which are provided at an end portion of the reciprocating base 51 and conduct side-face press working to the side-face portion of the work, having the same functions and effects as those of the first embodiment respectively.

Further, the side-face working apparatus 49, as shown in FIG. 8, includes oil-pressure driving means to reciprocate the reciprocating base 51 for side-face press working. Specifically, the oil-pressure driving means includes a piston driver 56 that moves a piston rod 57 by supplied oil pressure, whose end is coupled to the reciprocating base 51, and an oil-pressure controller 53 that supplies oil pressure for driving to the piston driver 56 through oil-pressure hoses 54, 55, which also has the function of oil-pressure source.

In this embodiment as well, in which detailed description will be omitted, the oil-pressure driving means can move appropriately the reciprocating base 51 equipped with the side-face working portion to conduct side-face press working to the work. Meanwhile, when the side-face press working is not done, the reciprocating base 51 is moved back away from the work W and then the rotating base 50 is rotated, so that the side-face working apparatus moves to its avoidance position, in which it does not prevent the upper and lower dies from conducting the press working thereby.

Other Embodiments

Herein, any improvements or modifications can be adopted within the scope of the technical concept of the present invention, and those improvements or modifications should belong to the present invention.

The above-described embodiments shows a case where a sheet of steal panel is worked at once by press working with the upper and lower dies through the first drawing step (drawing), the second drawing step (forming), and a drawing finishing step (listing) in order. However, this is not limited by particular working steps, and other working steps can be adopted. Namely, for example, in the event that press working is difficult to conduct at once (especially, in a case where a work to be formed has a relatively great drawing depth), the first half of press working steps, such as rough drawing step (for example, the first drawing), may be conducted in advance by another press machine, and then the work to which the press working has been conducted is transferred and set in the present press machine shown in the above-described embodiments. Then, the upper and lower dies of the press machine described in the present embodiments may conduct the subsequent working steps (for example, the second drawing step, drawing finishing step, and excising step). In this case, the side-face press working subsequent to the press working by the upper and lower dies is conducted by the same press machine, and thus this can also perform the same functions and effects of the present invention.

Herein, the side-face working apparatus 17, 31, 49 is not limited by a particular one that conducts working to only the vertical side face 3*g* of the work W, but it may also conducts the working easily to a slanted side face of the work W that is formed by moving the bearing portion 4*c* and the stopper 4*b* of the body 4 supporting the rotating base 18, 34, 50 and thereby changing an inclination of the rotating base 18, 34, 50.

Further, the reciprocating driving means is not limited by a particular driving mechanism as long as it can move the reciprocating base 19. For example, fluid pressure devices with oil or air may be adopted to move the reciprocating base 19 for the reciprocating driving means.

However, the structure that makes use of the movements of the ram 4*d* and the upper die 7 going down, like the first embodiment, is very useful because no other driving sources for the side-face press working is necessary.

Further, as shown in FIG. 2(*b*), the above-described embodiment shows a case where the side-face working apparatus 17, 17 . . . is disposed at least at three positions around the lower die 8 to conduct press working to at least three side-face portions of the door inner panel, which are located at the sides of vehicle front, rear and lower, respectively. However, in the event that a vehicle door structure having so-called a press door needs to have side-face press working (piercing and the like) conduced to an upper-side portion of its door frame, the side-face working apparatus may be disposed at additional position to the above three positions as well so as to conduct the press working to its corresponding portion (namely, it maybe disposed at four positions or five positions).

Further, a power source of the driving apparatus 30 shown in FIG. 5 is not limited to oil pressure, but other power sources, such as an air or water pressure and a gear-reduction mechanism with a motor, may be adopted.

Further, a work to be conducted by the press working is not limited by the door inner panel for vehicles, but the press working may be conducted to other components for vehicles that need drawing, such as a trunk lid and a hood. Also, of course, other works than that for vehicles may be adopted.

What is claimed is:

1. A compound press-forming apparatus including an upper die fixed to an elevated-side portion of a press machine that is moved up and down by an elevator, a lower die fixed to a fixed-side portion of the press machine, and working portions formed at respective corresponding portions of the upper and lower dies to conduct press working to a work jointly, comprising:

a side-face working apparatus that is disposed at a side of said lower die on the fixed-side portion of the press machine to conduct side-face press working to a side-face portion of the work jointly with the lower die, wherein said side-face working apparatus comprises a rotating base that is supported on the fixed-side portion of the press machine so as to rotate thereon, a reciprocating base that is supported on said rotating base so as to reciprocate thereon, a side-face working portion that is formed at an end portion of said reciprocating base to conduct side-face press working to the side-face portion of the work jointly with said lower die, and reciprocating driving means for moving said reciprocating base with said side-face working portion from an original position, in which said side-face working portion is away from the work, to a side-face press working position, in which the side-face press working is conducted to the work by said side-face working portion, and said side-face working apparatus is constituted such that it moves to an avoidance position, in which the side-face working apparatus is not in the way of the upper die going up and down, during said press working by the upper and lower dies, whereas it moves to a working capable position, in which said side-face press working is capable, after the upper die goes up, during said side-face press working by the side-face working portion and the lower die.

2. The compound press-forming apparatus of claim 1, wherein said side-face working apparatus is constituted so as to move between said avoidance position and said working capable position according to rotation of said rotating base of the side-face working apparatus.

3. The compound press-forming apparatus of claim 2, wherein said rotating base is supported on the fixed-side portion of the press machine through a bearing portion so as to rotate thereon, and comprises a driving apparatus that rotates said rotating base and a stopper that is disposed on the fixed-side portion of the press machine and supports said rotating base together with said bearing portion by making a top end thereof contact the rotating base, and said avoidance position of the side-face working apparatus is provided by rotating said rotating base to its inverted position, whereas said working capable position of the side-face working apparatus is provided by rotating said rotating base to its laid position in which the rotating base is put on said stopper.

4. The compound press-forming apparatus of claim 2, wherein said reciprocating driving means comprises a driving cam portion that includes a slant face disposed at a lower face of said upper die, a sliding cam-follower portion that is disposed at an upper face of said reciprocating base and constituted so as to slide by being pushed by said slant face of said driving cam portion when said upper die goes down according to the press machine's operation, and returning means that urges said reciprocating base to return from said side-face press working position to said original position on said rotating base and is constituted of a spring.

5. The compound press-forming apparatus of claim 2, wherein said work to be conducted by the press working is a door inner panel for vehicles, steps of drawing and excising are conducted to a flat portion of said door inner panel by said press working of the upper and lower dies, whereas a step of excising is conducted to a side-face portion of the door inner panel by said side-face press working of the side-face working apparatus and the lower die.

6. The compound press-forming apparatus of claim 5, wherein said side-face working apparatus is constituted so as to be disposed at least at three positions around said lower die to conduct press working to at least three side-face portions of said door inner panel, which are located at the sides of vehicle front, rear and lower, respectively.

7. A compound press-forming apparatus including an upper die fixed to an elevated-side portion of a press machine that is moved up and down by an elevator, a lower die fixed to a fixed-side portion of the press machine, and working portions formed at respective corresponding portions of the upper and lower dies to conduct press working to a work jointly, comprising:

a side-face working apparatus that is disposed at a side of said lower die on the fixed-side portion of the press machine to conduct side-face press working to a side-face portion of the work jointly with the lower die, wherein said side-face working apparatus comprises a rotating base that is supported on the fixed-side portion of the press machine so as to rotate thereon, a side-face working portion that is formed to conduct side-face press working to the side-face portion of the work jointly with said lower die, and driving means for moving said side-face working portion from an original position, in which said side-face working portion is away from the work, to a side-face press working position, in which the side-face press working is conducted to the work by said side-face working portion, and said side-face working apparatus is constituted such that it moves to an avoidance position, in which the side-face working apparatus is not in the way of the upper die going up and down, during said press working by the upper and lower dies, whereas it moves to a working capable position, in which said side-face press working is capable, after the upper die goes up, during said side-face press working by the side-face working portion and the lower die.

8. A compound press-forming apparatus including an upper die fixed to an elevated-side portion of a press machine that is moved up and down by an elevator, a lower die fixed to a fixed-side portion of the press machine, and working portions formed at respective corresponding portions of the upper and lower dies to conduct press working to a work jointly, comprising:

a side-face working apparatus that is disposed at a side of said lower die on the fixed-side portion of the press machine to conduct side-face press working to a side-face portion of the work jointly with the lower die, wherein said side-face working apparatus comprises a rotating base that is supported on the fixed-side portion of the press machine so as to rotate thereon, a side-face working portion that is formed to conduct side-face press working to the side-face portion of the work jointly with said lower die, and oil-pressure driving means for moving said side-face working portion from an original position, in which said side-face working portion is away from the work, to a side-face press working position, in which the side-face press working is conducted to the work by said side-face working portion, and said side-face working apparatus is constituted such that it moves to an avoidance position, in which the side-face working apparatus is not in the way of the upper die going up and down, during said press working by the upper and lower dies, whereas it moves to a working capable position, in which said side-face press working is capable, after the upper die goes up, during said side-face press working by the side-face working portion and the lower die.

9. The compound press-forming apparatus of claim 8, wherein said side-face working apparatus is constituted so as to move between said avoidance position and said working capable position according to rotation of said rotating base of the side-face working apparatus.

10. The compound press-forming apparatus of claim 9, wherein said rotating base is supported on the fixed-side portion of the press machine through a bearing portion so as to rotate thereon, and comprises a driving apparatus that rotates said rotating base and a stopper that is disposed on the fixed-side portion of the press machine and supports said rotating base together with said bearing portion by making a top end thereof contact the rotating base, and said avoidance position of the side-face working apparatus is provided by rotating said rotating base to its inverted position, whereas said working capable position of the side-face working apparatus is provided by rotating said rotating base to its laid position in which the rotating base is put on said stopper.

11. The compound press-forming apparatus of claim 9, wherein said oil pressure driving means comprises a piston driving portion that is driven by oil pressure, a piston that is provided with said side-face working portion at an end thereof, and an oil pressure controller that controls oil pressure supplied to said piston driving portion.

12. The compound press-forming apparatus of claim 9, wherein said side-face working apparatus further comprises a reciprocating base that is supported on said rotating base so as to reciprocate thereon and provided with said working portion at an end thereof, and said oil-pressure driving means comprises a piston driving portion that is driven by oil pressure, a piston rod having one end coupled to the piston driving portion and another end coupled to said reciprocating base, and an oil pressure controller that controls oil pressure supplied to said piston driving portion.

13. The compound press-forming apparatus of claim 9, wherein said work to be conducted by the press working is a door inner panel for vehicles, steps of drawing and excising are conducted to a flat portion of said door inner panel by said press working of the upper and lower dies, whereas a step of excising is conducted to a side-face portion of the door inner panel by said side-face press working of the side-face working apparatus and the lower die.

14. The compound press-forming apparatus of claim 13, wherein said side-face working apparatus is constituted so as to be disposed at least at three positions around said lower die to conduct press working to at least three side-face portions of said door inner panel, which are located at the sides of vehicle front, rear and lower, respectively.

* * * * *